US005281040A

United States Patent [19]

Hodkin et al.

[11] Patent Number: 5,281,040

[45] Date of Patent: Jan. 25, 1994

[54] RING BINDER MECHANISMS

[76] Inventors: Richard K. Hodkin, The Old Mill House. St. Mary's; Nigel Eagers, 31 Belvedere Mews St. Mary's, both of, Chalford, Gloucestershire, Great Britain

[21] Appl. No.: 772,380

[22] PCT Filed: May 9, 1990

[86] PCT No.: PCT/GB90/00714

§ 371 Date: Jan. 8, 1992

§ 102(e) Date: Jan. 8, 1992

[87] PCT Pub. No.: WO90/13440

PCT Pub. Date: Nov. 15, 1990

[30] Foreign Application Priority Data

May 12, 1989 [GB] United Kingdom ..... 8910912

[51] Int. Cl.[5] ..... B42F 13/18

[52] U.S. Cl. ..... 402/56; 402/46; 402/80 P

[58] Field of Search ..... 402/46, 55, 56, 80 P

[56] References Cited

U.S. PATENT DOCUMENTS

| | | | |
|---|---|---|---|
| 627,277 | 6/1899 | Shivers | 402/55 |
| 1,745,663 | 2/1930 | Eifel | 402/56 |
| 1,815,351 | 7/1931 | Eifel | 402/55 |
| 3,251,364 | 5/1966 | Goldman | 402/80 P X |
| 4,730,950 | 3/1988 | Ominato | 402/46 X |

FOREIGN PATENT DOCUMENTS

| | | | |
|---|---|---|---|
| 81639 | 6/1895 | Fed. Rep. of Germany . | |
| 656635 | 10/1963 | Italy | 402/80 P |

*Primary Examiner*—Paul A. Bell

*Attorney, Agent, or Firm*—Young & Thompson

[57] ABSTRACT

A ring binder mechanism comprises a fixed part (10) for mounting on a folder, and a movable part (13) connected to the fixed part by a four-bar-chain linkage (15) allowing translational movement of the movable part relatively to the fixed part between an open position and a closed position. The movable part (13) is also connected to the fixed part (10) by a pair of resiliently deformable links (17) which provide a spring-loaded over-center device. Two pairs of paper-holding elements (18, 21) are provided, the elements of each pair being separated in the open position of the movable part (13) but being brought into engagement with one another in the closed position, so as to prevent removal of sheets of paper threaded thereon. The fixed part (10), the movable part (13), the paper-holding elements (18, 21), the four-bar-chain (15), and the over-center device (17) are integrally formed with one another as parts of a single plastics moulding.

8 Claims, 1 Drawing Sheet

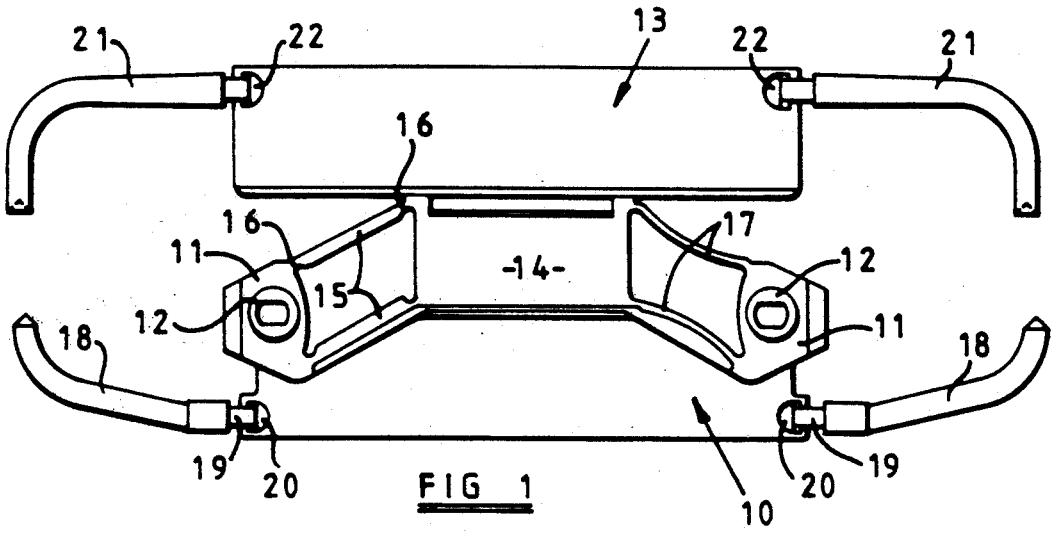
FIG 1
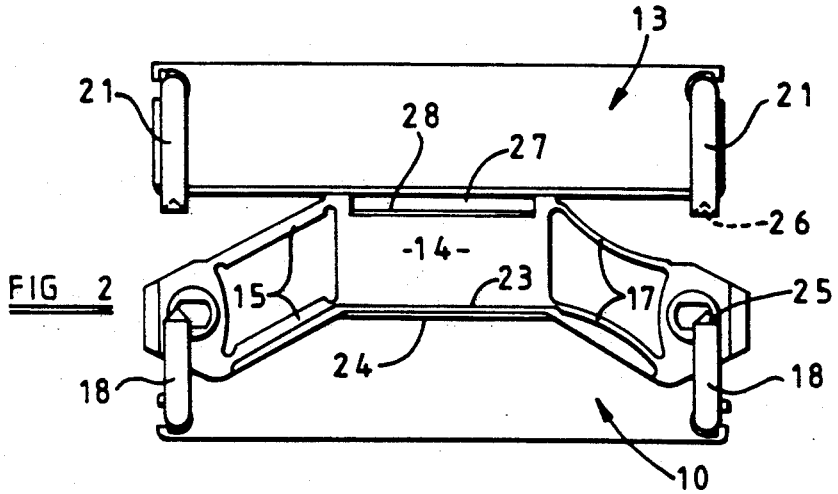
FIG 2
FIG 3
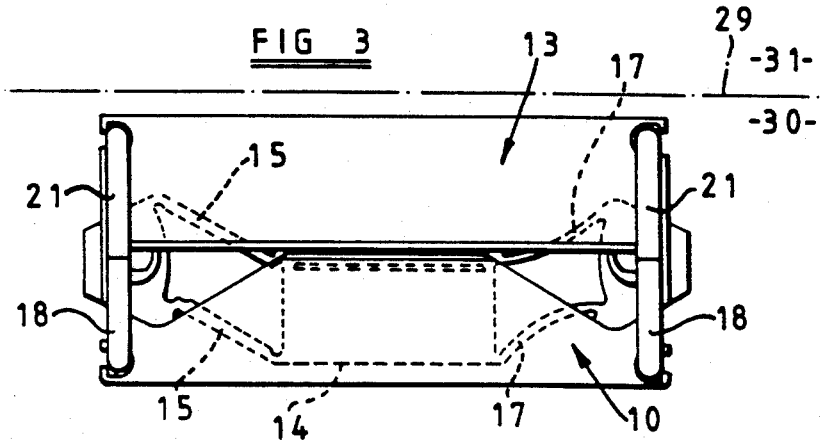

RING BINDER MECHANISMS

The invention relates to ring binder mechanisms such as are commonly used to mount a sheaf of papers within a folder so that by opening and closing the binder mechanism sheets may be readily added to, or removed from, the sheaf of papers.

The most common type of binder mechanism comprises a metal base plate on which are mounted two or more spaced rings, each ring being made in two parts which are separable to enable papers to be inserted on or withdrawn from the rings, each sheet of paper being formed with holes adjacent one edge for this purpose. There are many different forms of ring binder mechanisms and various ways in which the rings may be opened and closed, such as operating levers or over-centre spring mechanisms.

In one common type of over-centre spring mechanism the two parts of each ring are mounted on separate elongate metal strips which are wedged together side by side between flanges on the underside of a metal base plate. The metal base plate is resilient and acts as a spring which, by pressing on the sides of the longitudinal strips, causes them to be angled upwardly or downwardly relatively to one another. When the rings are pulled open the strips are angled upwardly and when the two parts of each ring are pressed together to close the ring the pressure on the strips pushes them downwardly through an over-centre position until they are angled downwardly, being kept in this position by the spring pressure exerted by the flanges on the base plate.

While this type of binder mechanism is generally effective, it suffers from several disadvantages. Due to its design it is virtually essential for the mechanism to be formed from metal, and it usually comprises seven or more separate component parts which have to be assembled together by hand. Accordingly the manufacturing cost of such mechanisms is comparatively high. Since the rings stand up from the base plate at all times, such mechanisms take up a considerable amount of storage space before being fitted to folders, and when the binder mechanisms are eventually fitted to folders, the folders themselves also consume a large amount of storage space since they cannot be stored flat.

To provide the necessary security for papers a strong spring action is required and the rings may then be difficult to open and close, the sharp ends of the rings sometimes causing damage to fingers and fingernails. In spite of the strong spring action, such mechanisms are also liable to open if the folder is dropped or otherwise subjected a sudden shock. Finally, the mechanism can only be supplied in colour by carrying out a costly additional painting or enamelling process, and such colour is in any case liable to wear off in use of the mechanism.

The present invention sets out to provide an improved form of ring binder mechanism which may overcome some of the above mentioned disadvantages. Although such mechanisms are, for convenience, conventionally referred to as "ring" binder mechanisms, it is to be understood that the present invention is not limited to the use of rings, circular or otherwise, for the purpose of holding papers and includes any arrangement where a paper-holding device is provided which comprises two portions of any suitable shape which can be brought into and out of engagement.

According to one aspect of the present invention there is provided a ring binder mechanism comprising a fixed part having means for connecting it to a part of a folder or the like, and a movable part connected to the fixed part by connecting means allowing translational movement of the movable part relatively to the fixed part between an open position and a closed position, said connecting means including a spring-loaded over-centre device, and at least one paper-holding device comprising two portions carried on the fixed and movable part respectively, at least one of which portions is capable of having threaded over it holes in a plurality of sheets of paper or the like, which portions are separated in said open position of said movable part but are brought into engagement with one another, in the closed position thereof, in such manner as to prevent removal from the mechanism of sheets threaded on to said one portion of the paper-holding device.

In a preferred embodiment of the invention the connecting means include a four-bar-chain linkage. In this case the spring-loaded over-centre device may comprise one or more resiliently deformable links connected between the fixed part and the movable part, said link or links reaching a position of maximum deformation between said open and closed positions.

Preferably the fixed and movable parts are formed with inter-engaging guide surfaces to assist in guiding the movable part as it moves between the open and closed positions. Latch means may be provided for locating and retaining said movable part in the closed position and/or in the open position.

The connecting means may be integral with at least one of said parts, and are preferably integral with both said parts. The portions of the paper-holding device are also preferably integrally formed with the parts which carry them. In this case a substantial portion of the mechanism, and preferably the whole mechanism, may be formed in one integral piece and thus may be moulded in plastics as a single item.

Accordingly, the invention also provides, in a second aspect thereof, a ring binder mechanism comprising a fixed part having means for connecting it to a part of a folder or the like, and paper-holding means comprising two portions movable into and out of engagement with one another under the control of a spring-loaded over-centre device, said portions being movable from an initial position where they lie substantially in the general plane of the rest of the binder mechanism to an operative position where they stand up transversely to said general plane, and wherein the fixed part, the paper-holding means and the over-centre are integrally formed with one another as parts of a unitary item.

Locking means are preferably provided to retain the elements in the operative position.

In any of the above arrangements, the two portions of the paper-holding means may comprise two elongate elements which are engageable end-to-end to define a loop which, in use, retains a sheet of paper or the like threaded on one or other of said portions.

The following is a more detailed description of an embodiment of the invention, by way of example, reference being made to the accompanying drawings in which:

FIG. 1 is a plan view of a one-piece plastics moulded binder mechanism according to the invention, FIG. 2 is a plan view of the mechanism in its operative and open position, and FIG. 3 is a similar view of the mechanism in its operative and closed position.

The ring binder mechanism shown in the drawings is moulded in one piece from suitable plastics material, such as polypropylene. FIG. 1 shows the mechanism in the form in which it emerges from the mould where it is substantially flat so that a large number of the mechanisms may be readily packed and stored in a small space, thus reducing packaging, storage and transport costs. The flat arrangement of the components of the mechanism also facilitates the moulding process, and the mechanism, in the form shown in FIG. 1, may be moulded from a simple two-part injection mould.

The mechanism comprises an elongate fixed part 10 having at opposite ends thereof forwardly projecting flanges 11 which are moulded with hollow bosses 12 through which bolts or rivets may be passed to secure the mechanism to a spine or cover portion of a cardboard folder cr the like, which is to enclose the papers held by the binder mechanism. As will be explained below, the mechanism is preferably mounted on the rear cover of the folder adjacent the spine but other mounting positions may also be used.

The mechanism further comprises an elongate movable part 13 which extends generally parallel to the fixed part 10 and is formed with a generally rectangular central projecting portion 14.

The left hand side of the projecting portion 14 is connected to the left hand flange 11 on the fixed part 10 by two spaced parallel inclined connecting links 15. The links 15, which are integrally moulded with the parts 14 and 11 are substantially rigid but are connected to the parts 14 and 11 by flexible portions 16 of reduced thickness. The arms 15 thus act as two bars of a four-bar-chain, permitting the portion 14 to move towards and away from the fixed part 10 while constraining the movable part 13 to remain parallel to the fixed part 10.

A second four-bar-chain is provided at the opposite side of the projecting portion 14 and includes two further inclined links 17 which connect the portion 14 of the movable part 13 to the right hand flange 11 of the fixed part 10. The links 17 are resiliently flexible and, as well as forming part of a second four-bar-chain, also provide a spring loaded over-centre connection between the fixed part 10 and the movable part 13. Instead of the two resilient links 17 shown, only a single such resilient link might be provided. Alternatively, any other suitable form of over-centre spring connection may be employed.

Integrally moulded with the fixed part 10, at opposite ends thereof, are two arms 18 forming part of the paper-holding device of the mechanism. As moulded and as shown in FIG. 1, the arms 18 are connected to the fixed part 10 by thin portions 19 and upstanding from the surface of the fixed part 10, adjacent the thin portions 19, are sockets 20. Each socket 20 is partly open on the side facing the respective arm 18. The arrangement is such that each arm 18 may be folded upwardly, by bending of the thin flexible positions 19, so as to extend substantially at right angles to the general plane of the mechanism shown in FIG. 1, and the lower end of the arm 18 may then be shapped sideways into the socket 20. The arm is preferably so shaped in section as to facilitate its entry and retention in the socket. For example the socket may be generally C-shaped, the arm 18, at least at its root, being of complementary cross-section.

Further arms 21, forming the complementary portions of the paper-retaining device, are similarly connected to opposite ends of the movable part 13 of the mechanism so that they also can be folded up to extend at right angles to the plane of the mechanism and retained in that position by snapping into sockets 22 on the movable part 13.

FIG. 2 is a plan view of the mechanism showing the arms 18 and 21 folded up to the operative position. In this position the mechanism is open so that paper formed with two holes adjacent one edge may be threaded over the arms 18 or 21 in conventional manner. When it is required to close the mechanism the movable part 13 is pushed towards the fixed part 10. The leading edge 23 of the projecting portion 14 of the movable part 13 passes beneath an adjacent flap portion 24 on the fixed part 10, the leading edges 14 and 23 being chamfered to facilitate this.

As the movable part 13 moves towards the fixed part 10 under the control of the four-bar-chain provided by the links 15, the links 17 compress resiliently until an overcentre position is reached, whereupon the links 17 expand again and snap the movable part 13 to the closed position shown in FIG. 3. In this position the projecting part 14 lies wholly beneath the fixed part 10, which is suitably shaped to receive the projecting part, and each arm 21 is brought into engagement with its corresponding arm 18 to complete a loop and thus retain any papers which have been threaded on to the arms 18. Each arm 18 is formed with a projecting conical end portion 25 which is received in a corresponding conical recess 26 in the associated arm 21.

The configuration of the links 15 and 17 is such that the links 17 are still under compressive stress when the mechanism has moved to the closed position shown in FIG. 3 and thus the links 17 serve as springs to retain the mechanism in the closed position. To assist further in retaining the mechanism in the closed position, the projecting part 14 is provided in its upper surface with an elongate recess 27 and the underside of the edge 24 of the fixed part 10 is provided with a corresponding downwardly projecting latch ridge (not shown) which snaps into the recess 27 in the closed position shown in FIG. 3. This serves to reduce any tendency for the mechanism to open due to sudden shock, such as when the folder containing the mechanism is dropped. When it is required to open the mechanism again the movable part 13 is simply pulled away from the fixed part 10 and the latch ridge on the underside of the fixed part 10 rides out of the recess 27 on a chamfered edge 28 thereof (see FIG. 2).

The latch ridge, by virtue of its engagement with the leading edge 23 of the projecting part 14, also serves as a temporary detent to retain the mechanism in the open position shown in FIG. 2.

As previously mentioned, the mechanism is preferably mounted on the rear cover panel of the folder for the papers, adjacent the spine of the folder. FIG. 3 shows in chain line the position of the fold 29 between the rear cover panel 30 and the spine 31. It will be seen that when the mechanism is closed, as shown in FIG. 3, the spine 31, extending as it does at right angles to the rear cover 30, will prevent accidental opening of the mechanism since the spine will be in the way of movement of the part 13 away from the fixed part 10. However, when the user wishes to open the mechanism, the folder will be folded flat so that the spine 31 lies in substantially the same plane as the rear panel 30 of the folder and thus the movable part 13 will be able to slide over the fold 31. Since the fold 31 may stand slightly above the surface of the back cover 30 and spine 31, the mechanism is preferably so arranged that the movable part 13 moves slightly clear of the surface 30 as it is withdrawn from the fixed part 10. This may be achieved, for example, by the flanges 11 being so positioned that the whole mechanism is slightly angled with respect to the surface on which it is mounted.

Since the mechanism can be moulded in one piece by a simple injection moulding process, it can be very cheap to produce since no manual assembly of components is required. The folding up of the arms 18 and 21 to the operative position can be left to the end user thus facilitating storage of the mechanisms. The mechanism may also be fitted to a folder with the arms 18 and 21 still folded down in the position shown in FIG. 1. This will enable the complete folder to be stored and transported flat thus saving considerable space. The arms 18 and 21 may then either be folded up to the operative position at the point of sale or it may be left to the end user to fold the arms to the operative position.

It will be appreciated that when the mechanism is in use the sheaf of papers held by the mechanism are supported on the arms 18 on the fixed part 10 of the mechanism and, consequently, the spring device 17 which is holding the two parts together is not subjected to forces acting on the sheaf of papers and does not therefore require to be strong enough to oppose such forces.

Instead of the mechanism being bolted or riveted to the folder, it may be permanently welded to a plastics folder or the binder mechanism may be supplied separately from folder, the end user mounting the mechanism on a selected folder by any conveniently operated fastening device, such as a plastics nut and bolt device.

Although the mechanism is shown as having two sets of arms 18 and 21, it will be appreciated that a modified form of the mechanism may use three or more such sets of arms. Also, the precise shapes of the arms 18 and 21 are not critical to the invention and the fixed part 10 and movable part 13 may instead be provided with any other suitable form of inter-engaging elements.

The arms 18 and 21 are preferably circular in overall cross-section, but with longitudinal rectangular section grooves extending along opposite sides thereof, to give a generally H-shaped section. This not only saves material but also avoids a large cross-section of solid plastics which would increase the required cooling time in the mould and hence slow production.

Since the mechanism is moulded in one piece from plastics material, it may readily be moulded in plastics material of any desired colour without additional operations or cost.

We claim:

1. A ring binder mechanism comprising a fixed part and a movable part extending generally parallel to one another; connecting means connected between the movable part and fixed part to allow translational movement of the movable part relatively to the fixed part between an open position and a closed position; said connecting means further comprising means for constraining said movable part to remain parallel to said fixed part during the translational movement of said movable part from the open position to said closed position; said connecting means including a spring-loaded over-centre device, said movable part, fixed part and connecting means being moulded from plastics material, and the over-centre device including at least one resiliently deformable link connected between the fixed part and the movable part so as to reach a position of maximum deformation between said open and closed positions, and at least one paper-holding device comprising two portions carried on the fixed and movable part respectively, at least one of which portions is capable of having threaded over it holes in a plurality of sheets of paper, which portions are separated in said open position of said movable part but are brought into engagement with one another, in the closed position thereof, in such manner as to prevent removal from the mechanism of sheets threaded on to said one portion of the paper-holding device.

2. A ring binder mechanism according to claim 1, wherein the over-centre device comprises two spaced generally parallel resiliently deformable links connected between the fixed part and the movable part, both links reaching a position of maximum deformation between said open and closed positions.

3. A ring binder mechanism according to claim 1, wherein the connecting means further includes two spaced parallel rigid links pivotally connected between the movable part and fixed part to permit the movable part to move towards and away from the fixed part while constraining the movable part and fixed part to remain parallel to one another.

4. A ring binder mechanism according to claim 1, wherein the movable part includes a projecting portion which projects towards the fixed part in the open position of the mechanism, and which passes beneath an adjacent flap portion on the fixed part as the movable part moves to the closed position of the mechanism.

5. A ring binder mechanism according to claim 1, wherein the fixed part, movable part and connecting means are moulded in one piece from plastics material so as to be integral with one another.

6. A ring binder mechanism according to claim 1, wherein the paper-holding device comprises a first elongate arm connected at one end to the fixed part and having a free extremity at its other end, and a second elongate arm connected at one end to the movable part and having a free extremity at its other end, the arms being upstanding from the fixed and movable parts, in an operative position, and the free extremities of the arms being brought into and out of engagement with one another by movement of the movable part towards and away from the fixed part.

7. A ring binder mechanism according to claim 6, wherein said one end of each elongate arm is connected to the respective one of the fixed part and movable part by a thin plastics portion integrally moulded with the arm and the part to which it is connected, each arm being foldable, by bending of the respective thin portion, from an initial position where it lies in the general plane of the part to which it is connected, to an operative position where it is upstanding with respect to said part, and is in said operative position.

8. A ring binder mechanism according to claim 6, wherein the part to which each elongate arm is connected is formed with a socket into which a part of the arm is engaged when the arm is folded to said upstanding position, to retain the arm in said upstanding position.

* * * * *